US009694262B1

(12) United States Patent
Myers

(10) Patent No.: US 9,694,262 B1
(45) Date of Patent: Jul. 4, 2017

(54) PUTTER WITH ADJUSTABLE HOSEL

(71) Applicant: Callaway Golf Company, Carlsbad, CA (US)

(72) Inventor: Matthew Myers, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 15/266,260

(22) Filed: Sep. 15, 2016

Related U.S. Application Data

(60) Provisional application No. 62/295,905, filed on Feb. 16, 2016.

(51) Int. Cl.

| | |
|---|---|
| ***A63B 53/06*** | (2015.01) |
| ***A63B 53/04*** | (2015.01) |
| ***A63B 53/02*** | (2015.01) |
| *A63B 53/00* | (2015.01) |

(52) U.S. Cl.
CPC ..... *A63B 53/065* (2013.01); *A63B 53/02* (2013.01); *A63B 53/0487* (2013.01); *A63B 53/007* (2013.01); *A63B 53/06* (2013.01); *A63B 2053/021* (2013.01); *A63B 2053/022* (2013.01); *A63B 2053/023* (2013.01); *A63B 2053/025* (2013.01); *A63B 2053/026* (2013.01); *A63B 2053/027* (2013.01); *A63B 2053/0416* (2013.01)

(58) Field of Classification Search
CPC ..... A63B 53/02; A63B 53/06; A63B 53/065; A63B 53/007; A63B 2053/021; A63B 2053/022; A63B 2053/023; A63B 2053/025; A63B 2053/026; A63B 2053/027
USPC ..... 473/305, 313, 314, 340
See application file for complete search history.

(56) References Cited

U.S. PATENT DOCUMENTS

| | | | | |
|---|---|---|---|---|
| 5,390,919 | A * | 2/1995 | Stubbs | A63B 53/065 473/246 |
| 5,533,730 | A * | 7/1996 | Ruvang | A63B 53/02 473/251 |
| 7,070,515 | B1 * | 7/2006 | Liu | A63B 53/065 473/251 |
| 8,870,674 | B1 * | 10/2014 | Abbott | A63B 53/06 473/238 |
| 2005/0233821 | A1 * | 10/2005 | Dombrowski | A63B 53/02 473/248 |
| 2008/0113824 | A1 * | 5/2008 | Pamias | A63B 53/007 473/246 |

(Continued)

FOREIGN PATENT DOCUMENTS

| | | | | |
|---|---|---|---|---|
| GB | 1232651 | A * | 5/1971 | A63B 53/02 |

*Primary Examiner* — Benjamin Layno
(74) *Attorney, Agent, or Firm* — Rebecca Hanovice; Michael Catania; Sonia Lari

(57) ABSTRACT

A putter comprising an adjustable hosel structure is disclosed herein. In particular, the putter comprises a hosel assembly comprising a shaft receiver and two interlocked bars that connect the shaft receiver to the putter head. A plurality of bolts connect the bars to the shaft receiver and the putter head, and these points of connection are joints about which the bars move, and which can be restrained to immobilize the hosel assembly or otherwise reversibly fix it in place so that a longitudinal shaft axis is aligned with a desired portion of the putter head. The hosel assembly preferably is adjustable along a horizontal, heel-to-toe axis, and is partially disposed, and secured, within a pocket on the heel side of the putter head.

20 Claims, 6 Drawing Sheets

(56) References Cited

U.S. PATENT DOCUMENTS

| | | | | |
|---|---|---|---|---|
| 2012/0115627 | A1* | 5/2012 | Pohl | A63B 53/007<br>473/251 |
| 2015/0045137 | A1* | 2/2015 | Esposito | A63B 53/02<br>473/307 |

* cited by examiner

PUTTER WITH ADJUSTABLE HOSEL

CROSS REFERENCES TO RELATED APPLICATIONS

The present application claims priority to U.S. Provisional Patent Application No. 62/295,905, filed on Feb. 16, 2016, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head, particularly a putter, with an adjustable hosel. In particular the adjustable hosel has a plurality of joints that allow the hosel to move along a heel to toe axis.

Description of the Related Art

The prior art discloses many different types of hosel adjustment features incorporated into golf club heads, and on putters in particular. Some examples include U.S. Pat. No. 6,264,571 and U.S. Patent Application Publication Number 2015/0045137. There still is a need, however, for a putter hosel adjustment system that allows a golfer to change the orientation of the hosel axis with respect to the putter head's center of gravity.

BRIEF SUMMARY OF THE INVENTION

One aspect of the present invention is a putter comprising a hosel that is adjustable along a lateral, heel-to-toe axis. In particular, the hosel comprises a pair of interlocked bars that permit movement and include locking features at their joints to give the hosel a large number of adjustment points.

Another aspect of the present invention is a putter head comprising a body comprising a striking face, a top surface, a bottom surface, a heel side, a toe side, and an attachment structure disposed at the heel side, and a hosel assembly comprising a shaft receiver, a straight bar, a V-shaped bar, and first, second, third, and fourth bolts, wherein the attachment structure comprises first and second through-bores, wherein the straight bar comprises a first end with a third through-bore and a second end with a fourth through-bore, wherein the V-shaped bar comprises a third end with a fifth through-bore and a fourth end with a sixth through-bore, wherein the shaft receiver comprises a shaft receptacle and seventh and eighth through-bores, wherein the first bolt extends through the first through-bore and the third through-bore to connect the straight bar to the attachment structure, wherein the second bolt extends through the second through-bore and the fifth through-bore to connect the V-shaped bar to the attachment structure, wherein the third bolt extends through the fourth through-bore and the seventh through-bore to connect the straight bar to the shaft receiver, and wherein the fourth bolt extends through the sixth through-bore and the eighth through-bore to connect the V-shaped bar to the shaft receiver.

In some embodiments, the heel side may comprise a pocket and the attachment structure may be disposed within the pocket. In other embodiments, the first through-bore may be disposed slightly higher than the second through bore along a vertical Z axis. In some embodiments, the putter head may comprise at least one mechanical fastener, which may be a locking nut, and which may be affixed to at least one of the first, second, third, and fourth bolts to reversibly immobilize the hosel assembly. In a further embodiment, the at least one mechanical fastener may comprise first, second, third, and fourth mechanical fasteners, the first mechanical fastener may be affixed to the first bolt, the second mechanical fastener may be affixed to the second bolt, the third mechanical fastener may be affixed to the third bolt, and the fourth mechanical fastener may be affixed to the fourth bolt.

In another embodiment, the putter head may comprise a shaft having a longitudinal axis and a center of gravity, the shaft may be disposed within the shaft receptacle, and the hosel assembly may be adjusted so that the longitudinal axis is aligned with the center of gravity. In a further embodiment, the hosel assembly may be adjusted so that the longitudinal axis is offset from the center of gravity along a horizontal Y axis. In other embodiments, the hosel assembly may comprise a lightweight material selected from the group consisting of aluminum alloy, stainless steel, carbon composite, and plastic.

Yet another aspect of the present invention is a putter comprising a shaft comprising a longitudinal axis, a head comprising a striking face, a top surface, a bottom surface, a heel side, a toe side, a heel-side pocket, and an attachment structure comprising first and second through-bores disposed within the pocket, a hosel assembly comprising a shaft receiver, a straight bar, a bent bar, and first, second, third, and fourth bolts, and at least one locking nut, wherein the straight bar comprises a first end with a third through-bore and a second end with a fourth through-bore, wherein the bent bar comprises a third end with a fifth through-bore and a fourth end with a sixth through-bore, wherein the shaft receiver comprises a shaft receptacle and seventh and eighth through-bores, wherein the first bolt extends through the first through-bore and the third through-bore to connect the straight bar to the attachment structure, wherein the second bolt extends through the second through-bore and the fifth through-bore to connect the bent bar to the attachment structure, wherein the third bolt extends through the fourth through-bore and the seventh through-bore to connect the straight bar to the shaft receiver, wherein the fourth bolt extends through the sixth through-bore and the eighth through-bore to connect the bent bar to the shaft receiver, and wherein the hosel assembly can be adjusted so that the longitudinal axis is offset from the center of gravity along a horizontal Y axis.

In some embodiments, the at least one locking nut may be engaged with at least one of the first, second, third, and fourth bolts, and tightening the at least one locking nut may reversibly immobilize the hosel assembly. In a further embodiment, the at least one locking nut may comprise first, second, third and fourth locking nuts, each of which may be engaged with one of the first, second, third, and fourth bolts. In other embodiments, each of the shaft receiver and the at least one locking nut may be composed of a tungsten alloy, and each of the straight bar and the bent bar may be composed of a lightweight material selected from the group consisting of aluminum alloy, stainless steel, carbon composite, and plastic. In alternative embodiments, the hosel assembly may comprise a tungsten alloy and an aluminum alloy.

In some embodiments, the attachment structure may extend from the pocket and be integrally formed with the head. In another embodiment, the putter may further comprise a face insert, the striking face may comprise a recess, and the face insert may be sized to fit within the recess. In a further embodiment, the face insert may comprise a polymeric material, the head may be composed of a first metal material having a first density, and the hosel assembly may comprise a second metal material having a second density that differs from the first density, which may be greater than the second density.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The present invention is directed to a golf club head, and particularly a putter, having a putter that can be moved along a heel-to-toe (Y) axis. The adjustable hosel permits a golfer to move the hosel, and therefore the shaft, of his or her putter so that the shaft axis can align with, or be located on either side of, the putter head's center of gravity, thus granting the golfer greater control over his or her putts.

Figure 1:
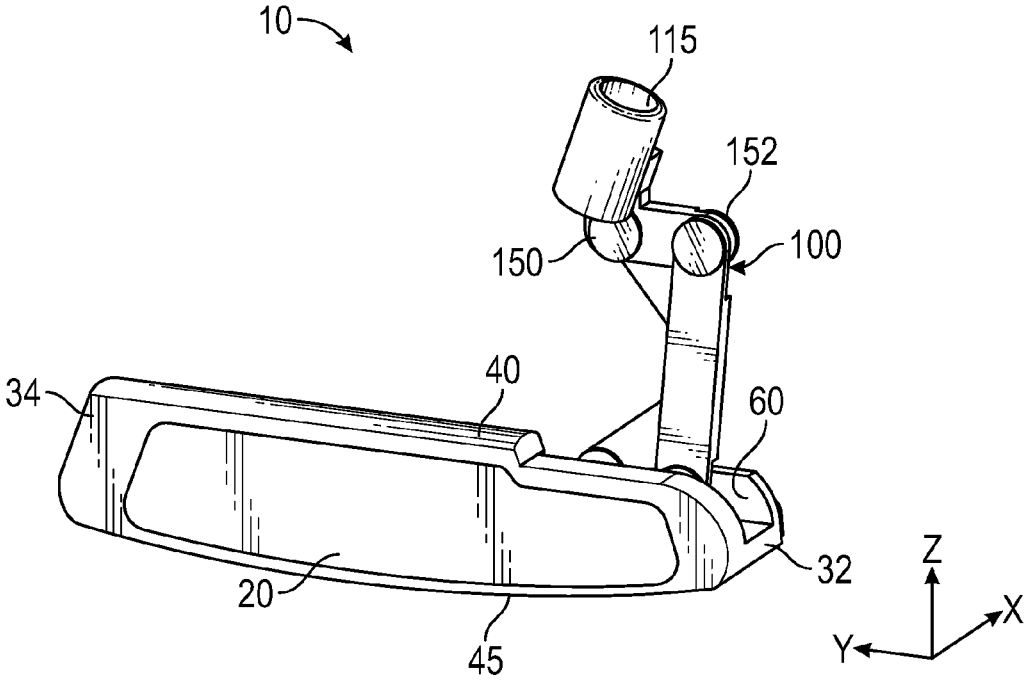
FIG. 1 is a front, perspective view of the putter head of the present invention.
Figure 2:
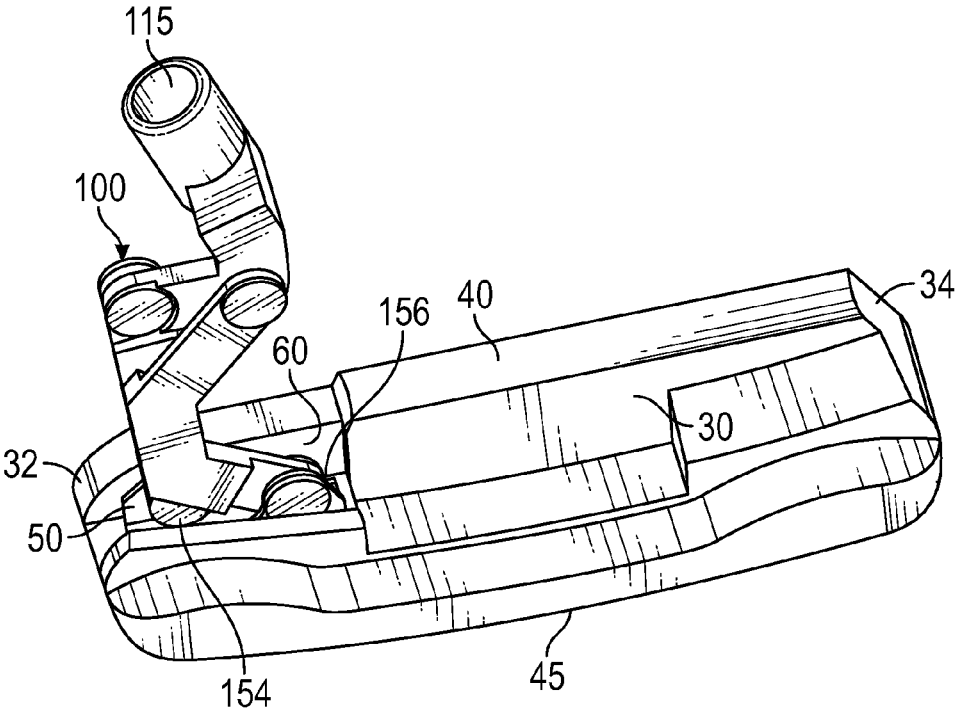
FIG. 2 is a rear, perspective view of the putter head shown in FIG. 1.
Figure 3:
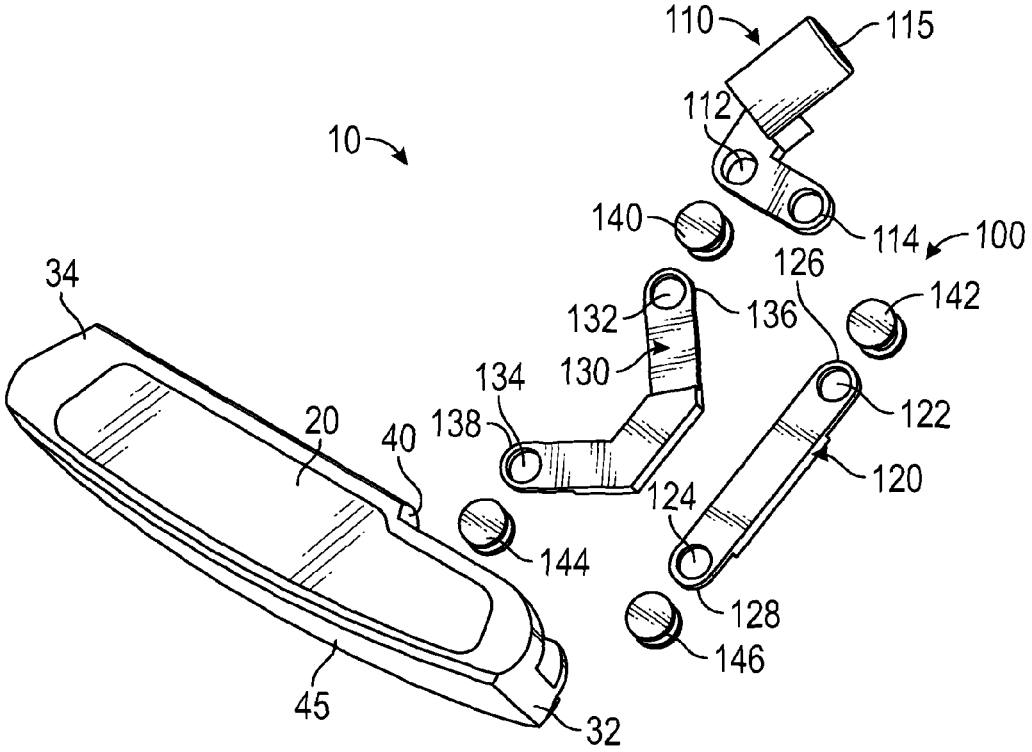
FIG. 3 is a front, perspective, exploded view of the putter head shown in FIG. 1.
Figure 4:
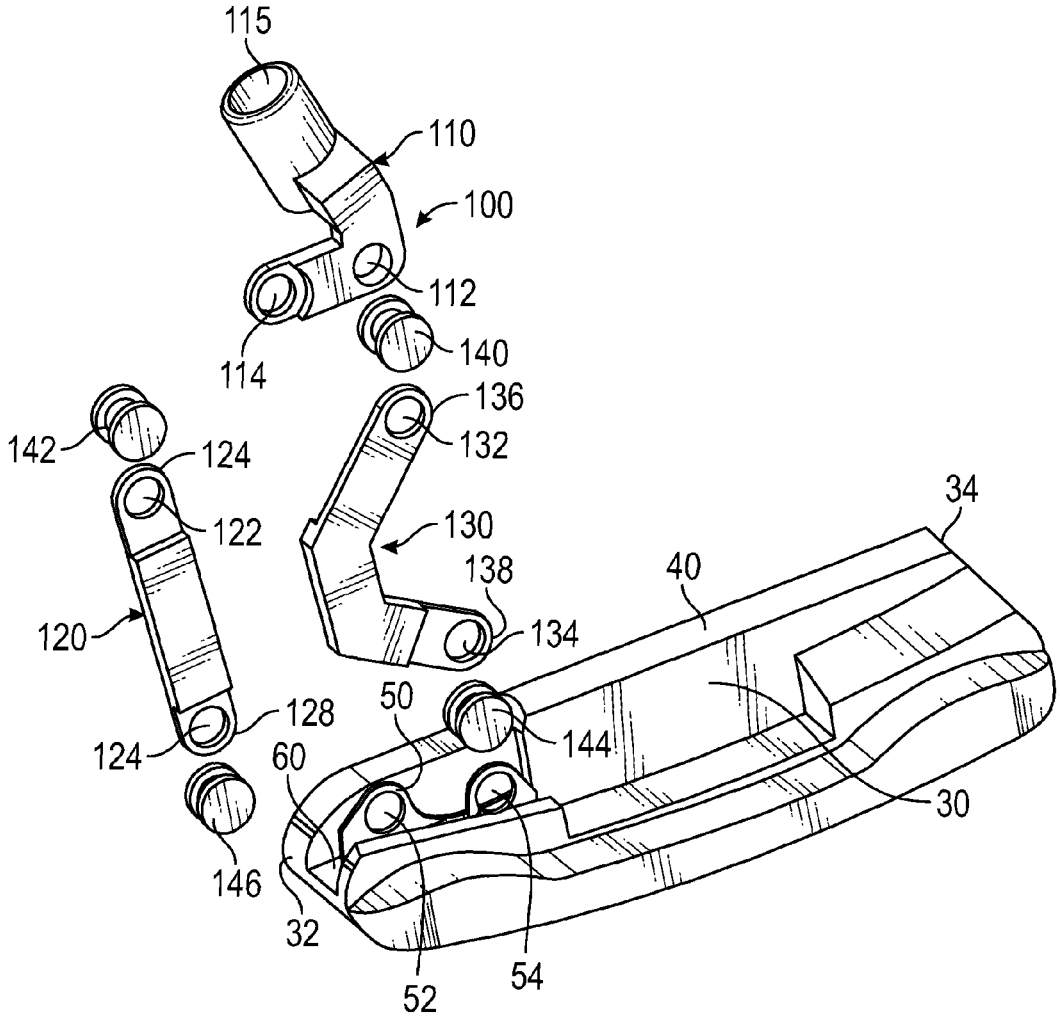
FIG. 4 is a rear, perspective, exploded view of the putter head shown in FIG. 1.
Figure 5:
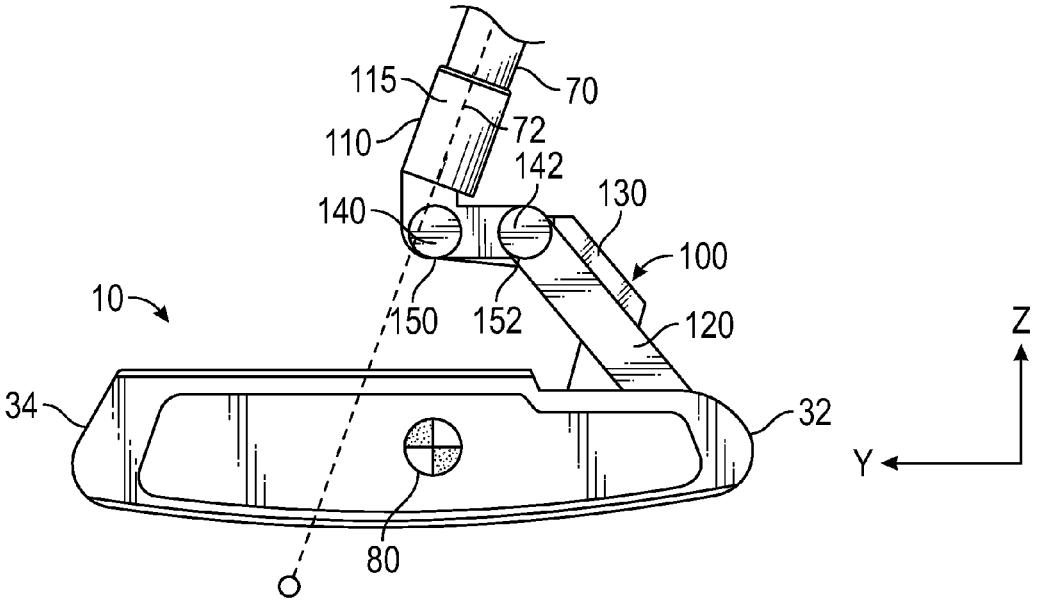
FIG. 5 is a front, plan view of the putter head shown in FIG. 1 with the hosel in a first configuration.
Figure 6:
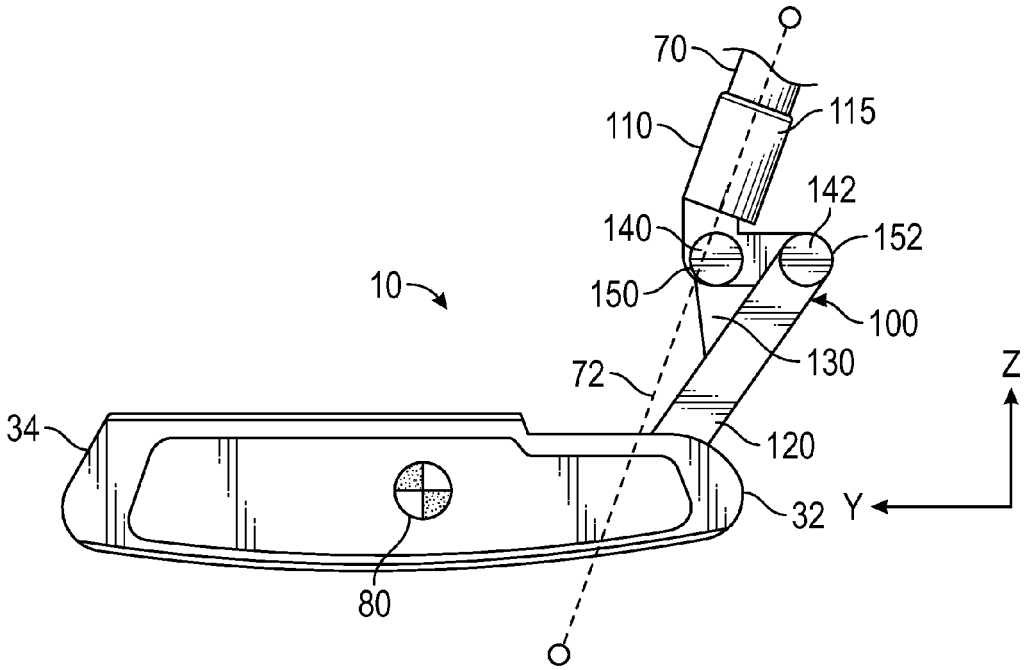
FIG. 6 is a front, plan view of the putter head shown in FIG. 2 with the hosel in a second configuration.
Figure 7:
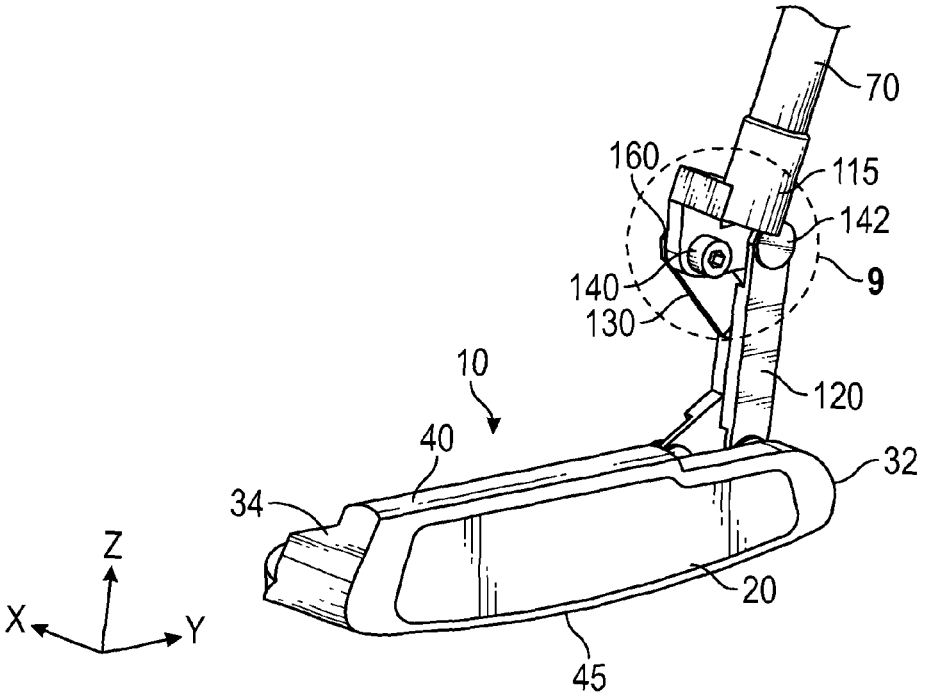
FIG. 7 is a front perspective view of the putter head shown in FIG. 1 engaged with a locking nut.
Figure 8:
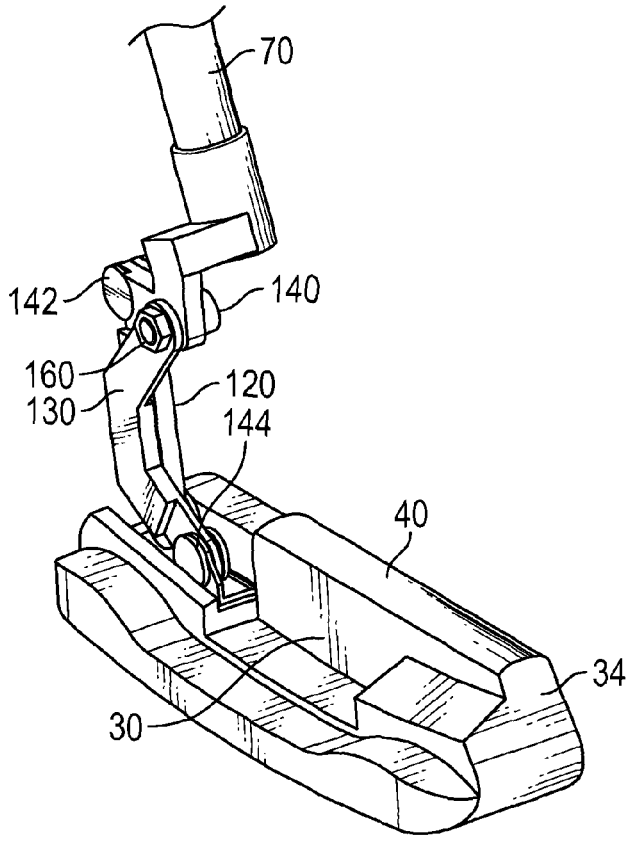
FIG. 8 is a rear perspective view of the putter head shown in FIG. 7.
Figure 9:
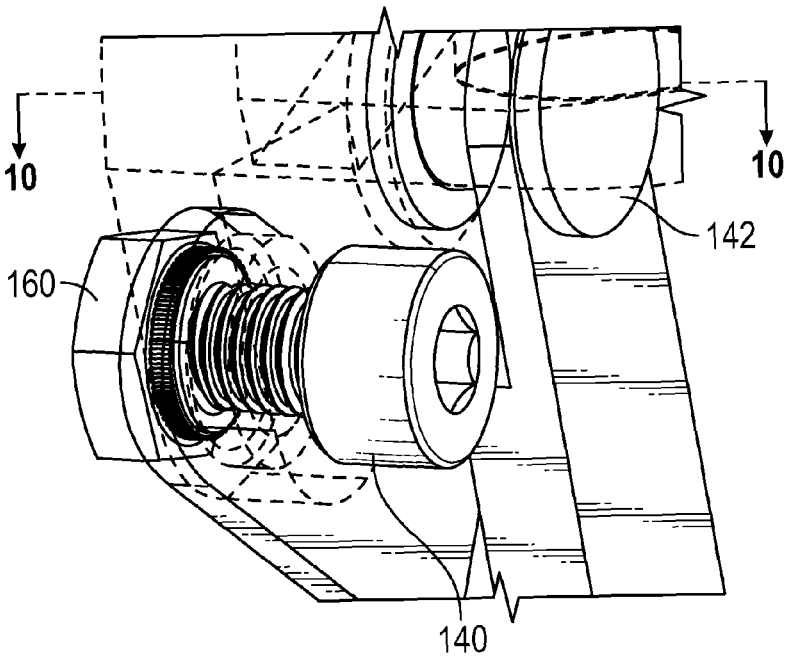
FIG. 9 is an enlarged, partially transparent view of the circled portion of the putter head shown in FIG. 7.
Figure 10:
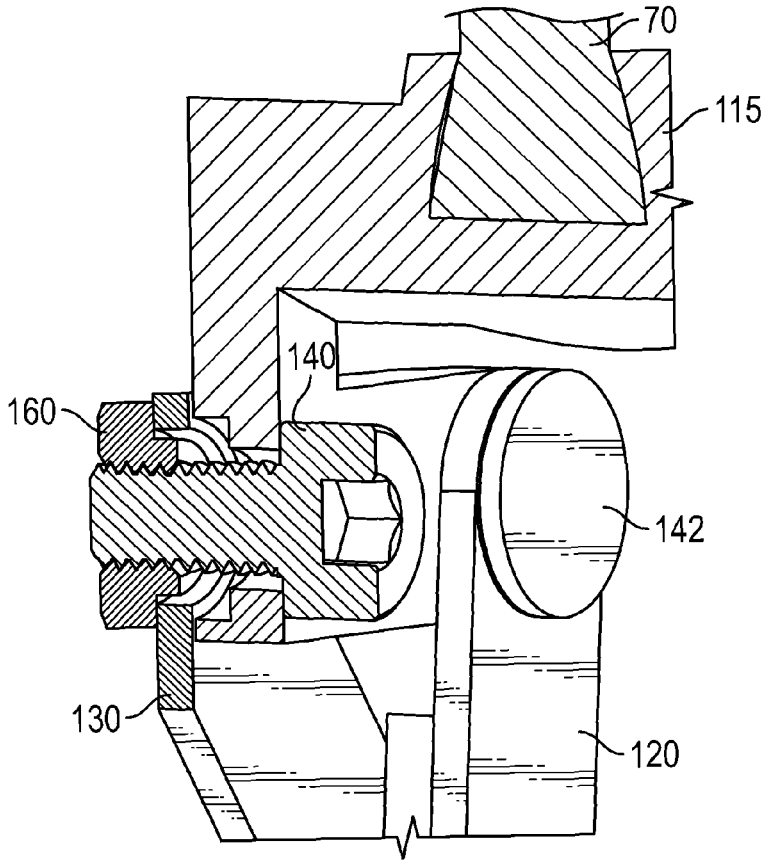
FIG. 10 is a cross-sectional view of the putter head shown in FIG. 9 along lines 10-10.

In the preferred embodiment, shown in FIGS. 1-10, the putter head 10 has a striking face 20 (which may be an insert composed of a polymeric material), a rear portion 30 opposite the striking face 20, a heel side 32, a toe side 34, top surface 40, a bottom surface 45, an attachment structure 50 disposed in a pocket 60 located at the heel side 32, and a hosel assembly 100 affixed to the attachment structure 50. The attachment structure 50 comprises a pair of through-bores 52, 54 disposed next to one another within the pocket 60. The first through-bore 52 is disposed slightly higher along the vertical Z axis, and closer to the heel side 32, than the second through-bore 54, but, as shown in FIG. 4, neither extends above the top surface 40 of the heel side 32.

The hosel assembly 100 is a multi-piece structure comprising a shaft receiver 110 with a cylindrical shaft receptacle 115 and pair of through-bores 112, 114 disposed below the shaft receptacle 115 and next to one another, a straight bar 120 with a pair of through-bores 122, 124, one located at each end 126, 128, and a bent or approximately V-shaped bar 130 with a pair of through-bores 132, 134, one located at each end 136, 138. As shown in the Figures, the shaft receiver 110 is attached to the straight bar 120 and the V-shaped bar 130 at their first ends 126, 136 with a first pair of connector bolts 140, 142, while the putter head 10 is attached to the second ends 128, 138 of the bars 120, 130 with a second pair of connector bolts 144, 146.

In particular, the first bolt 140 extends through the upper through-bore 132 of the V-shaped bar 130 and the first through-bore 112 of the shaft receiver 110 to movably affix the V-shaped bar 130 to the shaft receiver 110. The second bolt 142 extends through the upper through-bore 112 of the straight bar 120 and the second through-bore 114 of the shaft receiver 110 to movably affix the straight bar 120 to the shaft receiver 110. The third bolt 144 extends through the lower through-bore 134 of the V-shaped bar 130 and the second through-bore 54 of the attachment structure 50 to movably affix the V-shaped bar 130 to the putter head 10. The fourth bolt 146 extends through the lower through-bore 124 of the straight bar 120 and the first through-bore 52 of the attachment structure 50 to movably affix the straight bar 120 to the putter head 10. The bolts 140, 142, 144, 146 retain the hosel assembly 100 in a YZ plane, while allowing it to move along the Y axis. This permits a golfer to adjust the location of the longitudinal axis 72 of the shaft 70 with respect to the putter head 10 center of gravity 80.

When the golfer has adjusted the hosel assembly 100 so that the shaft axis 72 is in a desired location, he or she can reversibly lock the hosel assembly 100 at that location with at least one locking nut 160 that screws onto an end of at least one of the bolts 140, 142, 144, 146, as shown in FIGS. 7-10. The clamping pressure placed on the bars 120, 130 by the locking nut 160 and its respective bolt 140, 142, 144, 146 reversibly fixes the assembly 100 in the selected place. This effect can also be achieved by a clip, clamp, or other such mechanical retainer known to a person skilled in the art. A golfer can also use an adhesive material to reversibly or irreversibly lock the hosel assembly 100 in place. In any event, the locking nut 160, other mechanical retainer, or adhesive should be applied to the joints 150, 152, 154, 156 where the bars 120, 130 connect with the bolts 140, 142, 144, 146 to keep the bars 120, 130 from rotating around the bolts 140, 142, 144, 146.

The bolts 140, 142, 144, 146 and through-bores 52, 54, 112, 114, 122, 124, 132, 134 may also include mating ratcheting structures, such as those disclosed in U.S. Pat. No. 8,801,537, the disclosure of which is incorporated by reference in its entirety herein, to provide incremental adjustment points for the hosel assembly 100 and to provide audible signals to a user when an adjustment has been achieved.

The pieces of the hosel assembly 100 of the present invention, and particularly the bars 120, 130, preferably are composed of a lightweight, high strength material such as aluminum alloy, stainless steel, carbon composite, or plastic to reduce the overall weight of the putter head 10 and ensure a low center of gravity. The material composition of the hosel assembly 100 can, however, be adjusted as desired by the golfer to change the center of gravity location. For example, if the golfer wishes to raise the center of gravity of the putter head 10, she can dispose one or more bolts 140, 142 in the upper through-bores 112, 114 made from high density material such as tungsten alloy, and select a shaft receiver 110 made from such high density material. If the golfer wishes to ensure a low center of gravity, she can dispose one more bolts 144, 146 made from the high density material in the lower through-bores 52, 54.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim:

1. A putter head comprising:

a body comprising a striking face, a top surface, a bottom surface, a heel side, a toe side, and an attachment structure disposed at the heel side; and a hosel assembly comprising a shaft receiver, a straight bar, a V-shaped bar, and first, second, third, and fourth bolts, wherein the attachment structure comprises first and second through-bores, wherein the straight bar comprises a first end with a third through-bore and a second end with a fourth through-bore, wherein the V-shaped bar comprises a third end with a fifth through-bore and a fourth end with a sixth through-bore, wherein the shaft receiver comprises a shaft receptacle and seventh and eighth through-bores, wherein the first bolt extends through the first through-bore and the third through-bore to connect the straight bar to the attachment structure, wherein the second bolt extends through the second through-bore and the fifth through-bore to connect the V-shaped bar to the attachment structure, wherein the third bolt extends through the fourth through-bore and the seventh through-bore to connect the straight bar to the shaft receiver, and wherein the fourth bolt extends through the sixth through-bore and the eighth through-bore to connect the V-shaped bar to the shaft receiver.

2. The putter head of claim 1, wherein the heel side comprises a pocket, and wherein the attachment structure is disposed within the pocket.

3. The putter head of claim 1, wherein the first through-bore is disposed slightly higher than the second through bore along a vertical Z axis.

4. The putter head of claim 1, further comprising at least one mechanical fastener, wherein the at least one mechanical fastener is affixed to at least one of the first, second, third, and fourth bolts to reversibly immobilize the hosel assembly.

5. The putter head of claim 4, wherein the at least one mechanical fastener comprises first, second, third, and fourth mechanical fasteners, wherein the first mechanical fastener is affixed to the first bolt, wherein the second mechanical fastener is affixed to the second bolt, wherein the third mechanical fastener is affixed to the third bolt, and wherein the fourth mechanical fastener is affixed to the fourth bolt.

6. The putter head of claim 4, wherein the at least one mechanical fastener is a locking nut.

7. The putter head of claim 1, further comprising a shaft, wherein the putter head comprises a center of gravity, wherein the shaft is disposed within the shaft receptacle, wherein the shaft comprises a longitudinal axis, and wherein the hosel assembly can be adjusted so that the longitudinal axis is aligned with the center of gravity.

8. The putter head of claim 7, wherein the hosel assembly can be adjusted so that the longitudinal axis is offset from the center of gravity along a horizontal Y axis.

9. The putter head of claim 1, wherein the hosel assembly comprises a lightweight material selected from the group consisting of aluminum alloy, stainless steel, carbon composite, and plastic.

10. The putter head of claim 9, wherein the hosel assembly is composed of aluminum alloy.

11. A putter comprising:

a shaft comprising a longitudinal axis;

a head comprising a striking face, a top surface, a bottom surface, a heel side, a toe side, a heel-side pocket, and an attachment structure comprising first and second through-bores disposed within the pocket;

a hosel assembly comprising a shaft receiver, a straight bar, a bent bar, and first, second, third, and fourth bolts; and at least one locking nut, wherein the straight bar comprises a first end with a third through-bore and a second end with a fourth through-bore, wherein the bent bar comprises a third end with a fifth through-bore and a fourth end with a sixth through-bore, wherein the shaft receiver comprises a shaft receptacle and seventh and eighth through-bores, wherein the first bolt extends through the first through-bore and the third through-bore to connect the straight bar to the attachment structure, wherein the second bolt extends through the second through-bore and the fifth through-bore to connect the bent bar to the attachment structure, wherein the third bolt extends through the fourth through-bore and the seventh through-bore to connect the straight bar to the shaft receiver, wherein the fourth bolt extends through the sixth through-bore and the eighth through-bore to connect the bent bar to the shaft receiver, and wherein the hosel assembly can be adjusted so that the longitudinal axis is offset from the center of gravity along a horizontal Y axis.

12. The putter of claim 11, wherein the at least one locking nut is engaged with at least one of the first, second, third, and fourth bolts, and wherein tightening the at least one locking nut reversibly immobilizes the hosel assembly.

13. The putter of claim 12, wherein the at least one locking nut comprises first, second, third and fourth locking nuts, each of which is engaged with one of the first, second, third, and fourth bolts.

14. The putter of claim 11, wherein each of the shaft receiver and the at least one locking nut is composed of a tungsten alloy.

15. The putter of claim 11, wherein each of the straight bar and the bent bar is composed of a lightweight material selected from the group consisting of aluminum alloy, stainless steel, carbon composite, and plastic.

16. The putter of claim 11, wherein the hosel assembly comprises a tungsten alloy and an aluminum alloy.

17. The putter of claim 11, wherein the attachment structure extends from the pocket and is integrally formed with the head.

18. The putter of claim 11, further comprising a face insert, wherein the striking face comprises a recess, and wherein the face insert is sized to fit within the recess.

19. The putter of claim 18, wherein the face insert comprises a polymeric material, wherein the head is composed of a first metal material having a first density, and wherein the hosel assembly comprises a second metal material having a second density that differs from the first density.

20. The putter of claim 19, wherein the first density is greater than the second density.

* * * * *